US010106280B2

(12) United States Patent
Morselli et al.

(10) Patent No.: US 10,106,280 B2
(45) Date of Patent: Oct. 23, 2018

(54) PRODUCT WRAPPING UNIT FOR A PACKAGING LINE

(71) Applicant: Tetra Laval Holdings & Finance S.A., Pully (CH)

(72) Inventors: Alessandro Morselli, Castelfranco Emilia (IT); Fabio Ferrari, Formigine (IT); Tony Kinas, Greer, SC (US); Mathias N. Coulomb, Greenville, SC (US)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 15/552,391

(22) PCT Filed: Feb. 26, 2016

(86) PCT No.: PCT/EP2016/054068
§ 371 (c)(1),
(2) Date: Aug. 21, 2017

(87) PCT Pub. No.: WO2016/139139
PCT Pub. Date: Sep. 9, 2016

(65) Prior Publication Data

US 2018/0022487 A1 Jan. 25, 2018

(30) Foreign Application Priority Data

Mar. 2, 2015 (EP) ..... 15157202

(51) Int. Cl.
*B65B 11/10* (2006.01)
*B65B 35/20* (2006.01)
(Continued)

(52) U.S. Cl.
CPC ..... *B65B 11/10* (2013.01); *B65B 35/205* (2013.01); *B65B 35/405* (2013.01); *B65B 41/10* (2013.01); *B65B 49/10* (2013.01); *B65B 61/02* (2013.01)

(58) Field of Classification Search
CPC ..... B65B 11/10; B65B 35/205; B65B 35/405; B65B 41/10; B65B 49/10; B65B 61/02
See application file for complete search history.

(56) References Cited

U.S. PATENT DOCUMENTS 3,660,961 A * 5/1972 Ganz ..... B65B 11/10 53/210
3,715,859 A * 2/1973 Reinecke ..... B65B 11/10 53/209

(Continued)

FOREIGN PATENT DOCUMENTS

| | | |
|---|---|---|
| EP | 0 049 377 | 4/1982 |
| FR | 2 099 261 | 3/1972 |
| FR | 2 688 470 | 9/1993 |

OTHER PUBLICATIONS

International Search Report from corresponding PCT Application No. PCT/EP2016/054068 (2 pages).

*Primary Examiner* — Andrew M Tecco
*Assistant Examiner* — Chinyere Rushing-Tucker
(74) *Attorney, Agent, or Firm* — Finnegan, Henderson, Farabow, Garrett & Dunner, L.L.P.

(57) ABSTRACT

A wrapping unit (1) for a packaging line (2) comprises a conveyor (6) for feeding a succession of products (3) in a first direction (7) and a wrapping station (9) arranged along the conveyor (6) for wrapping a film (5) of wrapping material around said products (3), said wrapping station (9) comprising a wrapping device (13) provided with a plurality of wrapping members (15), each of said wrapping members (15) extending in a second direction (11) perpendicular to said first direction (7), said wrapping unit (1) further com-
(Continued)

prising a stability control group (12) for preventing said products (3) from tipping along said conveyor (6), said stability control group (12) comprising a plurality of anti-tip devices (33), each of said anti-tip devices (33) being associated, during operation, with a respective product (3) to move together with said respective product (3) through said wrapping station (9).

9 Claims, 9 Drawing Sheets

(51) Int. Cl.

| | |
|---|---|
| ***B65B 61/02*** | (2006.01) |
| ***B65B 41/10*** | (2006.01) |
| ***B65B 49/10*** | (2006.01) |
| ***B65B 35/40*** | (2006.01) |

(56) References Cited

U.S. PATENT DOCUMENTS

| | | | | |
|---|---|---|---|---|
| 5,626,002 | A * | 5/1997 | Ford | B65B 21/242 53/398 |
| 6,328,152 | B1 * | 12/2001 | Focke | B65B 19/225 198/468.1 |
| 2007/0199798 | A1 * | 8/2007 | Floding | B65B 35/405 198/429 |
| 2011/0000169 | A1 * | 1/2011 | Magri | B65B 11/10 53/450 |
| 2013/0042580 | A1 * | 2/2013 | May | B65B 17/025 53/457 |
| 2017/0361956 | A1 * | 12/2017 | Masotti | B65B 11/10 |

* cited by examiner

PRODUCT WRAPPING UNIT FOR A PACKAGING LINE

This is a National Phase of PCT Application No. PCT/EP2016/054068, filed Feb. 26, 2016, which claims the benefit of European Application No. 15157202.1 filed Mar. 2, 2015, both of which are incorporated herein by reference.

TECHNICAL FIELD

The present invention relates to a product wrapping unit for a packaging line.

Though the present invention is suitable for wrapping products in any type of packaging line, it may be used to particular advantage to wrap a packet or a multi-packet in a packaging line of pourable food products, such as milk, fruit juice, wine, etc., to which the following description refers purely by way of example.

BACKGROUND OF INVENTION

As known, in a packaging line of the above type packs are produced from a sheet packaging material, which is normally in the form of pre-cut blanks or a continuous strip and is subjected to a series of longitudinal folding and sealing operations to form a continuous tube of packaging material which, once filled, is sealed and cut transversely into individual packets.

The finished packets are then ordered to form two or more rows and are fed by a linear conveyor to a grouping and aligning unit, which is adapted to separate one or more, for example two, packet groups from the rest of the respective rows and to align the packet groups along a direction orthogonal to an advancement direction of the groups along the linear conveyor.

Downstream of the grouping and aligning unit, the packet groups first are moved through a wrapping station, where they are enveloped with a film of plastic heat-shrinkable material, and then are passed through an oven, where the film is heat-shrunk around each packet group so as to complete the formation of a respective multi-packet.

The wrapping station normally comprises a linear conveyor to advance the groups; a feeding device to feed sheet-cut film to an inlet of the linear conveyor; and a wrapping device having a plurality of bars which extend crosswise to the group advancement direction and are moved along an annular bar path extending around the linear conveyor. In particular, the bar path comprises a work stretch, along which the bars are moved in the same direction and at a higher speed than that of the groups so as to surmount and overtake them and resultingly wrap the film around the groups. The bar path further comprises a return stretch, along which the bars are moved below the linear conveyor in an opposite direction to the group advancement direction.

Though effective, the system described above has a drawback, due to the fact that at the inlet and outlet of the wrapping station and during the advancement through the wrapping station the packets are submitted to unavoidable stresses which may compromise the stability of the packets, in particular those with a relatively narrow rest base.

DISCLOSURE OF INVENTION

It is an object of the present invention to provide a product wrapping unit intended to mitigate the above drawbacks.

According to the present invention, there is provided a product wrapping unit for a packaging line, as claimed in claim 1 and preferably in any of the claims depending directly or indirectly to claim 1.

BRIEF DESCRIPTION OF THE DRAWINGS

A non-limiting embodiment of the present invention will be described by way of example with reference to the attached drawings, in which.

BRIEF DESCRIPTION OF THE DRAWINGS

Figure 1:
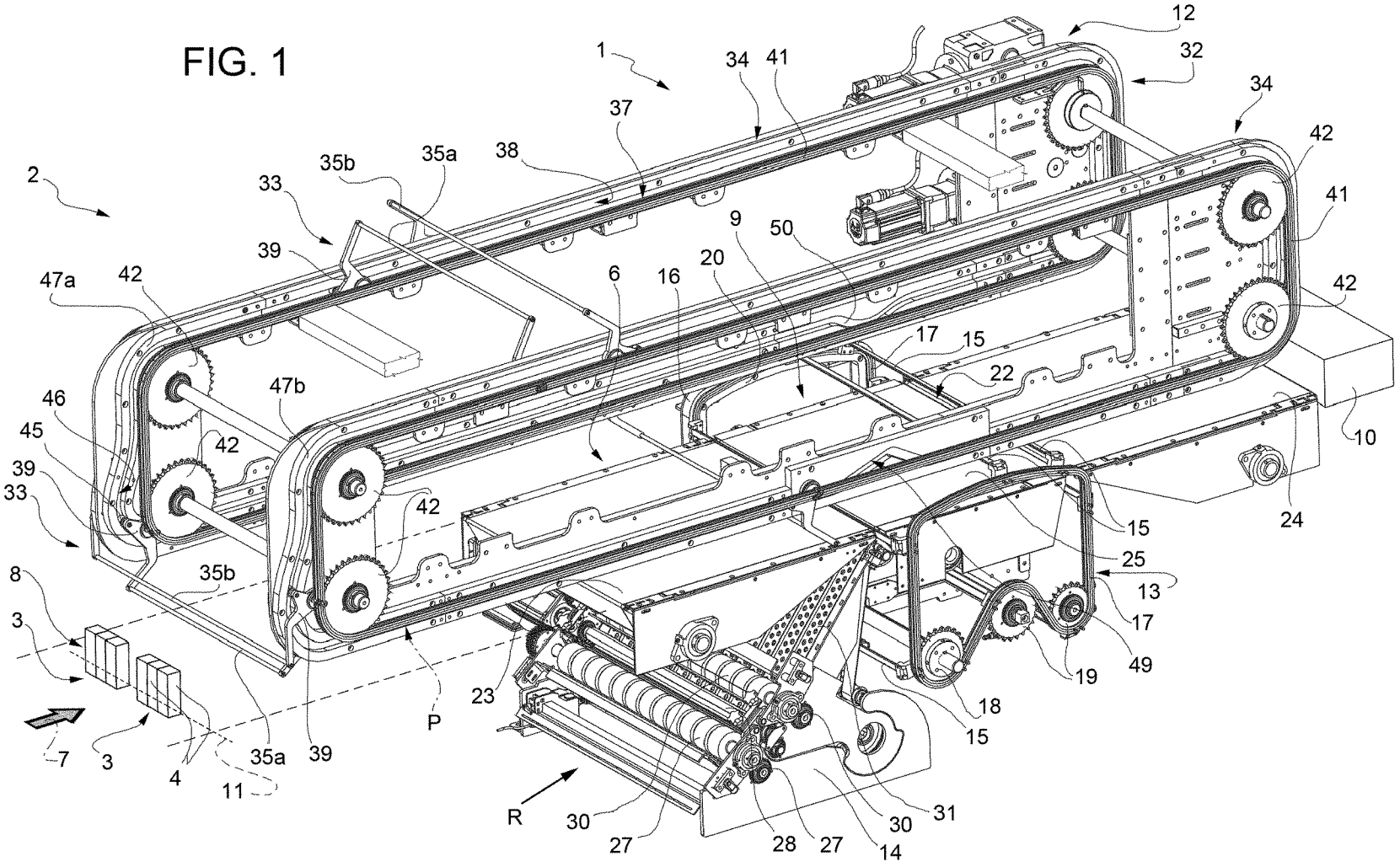
FIG. 1 shows a perspective view, with parts removed for clarity, of a preferred embodiment of the wrapping unit according to the present invention.

FIG. 1 shows a product wrapping unit, designated as a whole by reference numeral 1, in a packaging line 2.

In particular, in the example shown, the products are defined by multi-packets 3, each comprising a given number, three in the specific case, of individual packets 4, which are arranged next to one another in a compact arrangement and are preferably defined by respective aseptic packets of a pourable food product, such as fruit juice, milk, wine, etc.

For manufacturing packets 4 of this type, packaging line 2 comprises, in known manner:

a forming unit (not shown), in which packets 4 are formed from flat pre-cut blanks or from a continuous strip of material;

a filling unit (not shown);

a packet grouping and alignment unit (not shown), in which packets 4 are grouped and ordered to form relative multi-packets 3; and a wrapping unit, in which multi-packets 3 are wrapped with a film 5 of heat-shrinkable material.

As shown in FIG. 1, according to the present invention, wrapping unit 1 comprises a conveyor 6 (a linear conveyor in the embodiment shown) for continuously feeding, in an advancement direction 7, a succession of rows 8 of multi-packets 3 through a wrapping station 9, in which film 5 of heat-shrinkable material is wrapped around multi-packets 3.

The wrapping unit 1 further comprises an oven 10, which receives multi-packets 3 from wrapping station 9 and is provided with heating means (not shown) for heating film 5 wrapped around multi-packets 3 to form respective wrappings. Rows 8 are uniformly spaced apart along conveyor 6 and contain, each, one or more, two in the example shown, multi-packets 3 spaced from, and aligned with, one another in a direction 11 perpendicular to advancement direction 7.

Wrapping unit 1 comprises, finally, a stability control group 12, which will be described in detail hereinafter, and the function of which is to hinder a possible disequilibrium of packets 4 during advancement along conveyor 6, and, in particular, at wrapping station 9, so that each packet 4 maintains its upright position and stays aligned to packets 4 of the respective multi-packet 3 and respective of other multi-packets 3 arranged in the same row 8.

Figure 3:
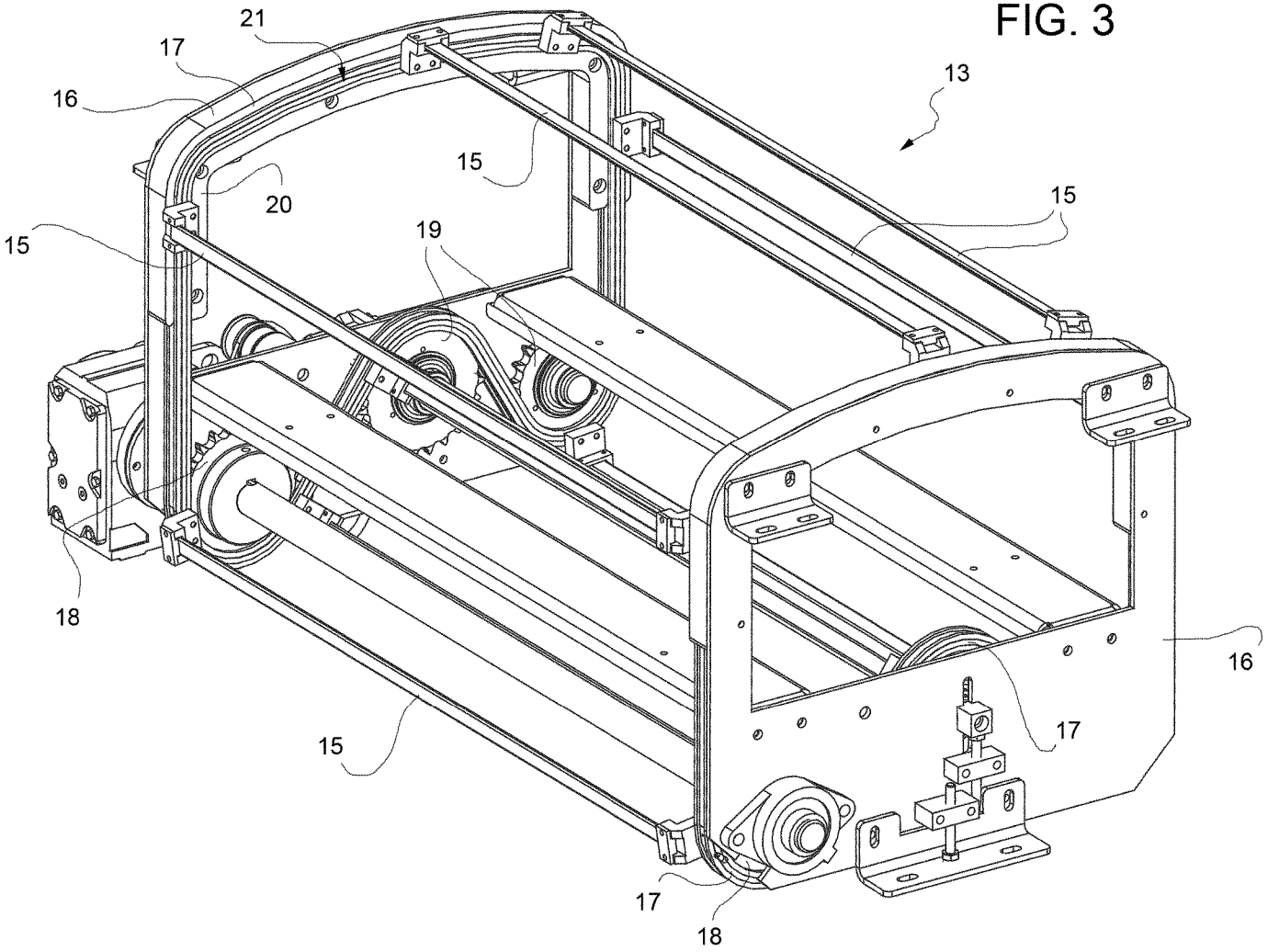
FIG. 3 shows a larger-scale perspective view of a further detail in FIG. 1.

As shown in FIGS. 1 and 3, wrapping station 9 comprises a wrapping device 13 of known type and a film feeding device 14, also of known type, which is arranged below conveyor 6 and before wrapping device 13 with respect to advancement direction 7 for feeding, during operation, film 5 cut into sheets to wrapping device 13.

Wrapping device 13 comprises (FIG. 3) a plurality of bars 15, which are parallel to each other and to direction 11 and are mounted on a frame comprising two support plates 16 to move all together along an annular path A comprising a work stretch A1 arranged above conveyor 6 and a return stretch disposed below conveyor 6.

In particular, support plates 16 are arranged on opposite sides and outside of conveyor 6, lie in respective vertical planes parallel to advancement direction 7. On the inner side facing the other plate 16, each support plate 16 carries a respective chain 17, which is looped around a driving pulley 18, is tensioned by a pair of tensioning pinions 19 arranged, as well as driving pulley 18, below conveyor 6 and engages in sliding manner a grooved guide 20 rigidly connected to a portion of respective plate 16 protruding above conveyor 6.

The chain 17 may be replaced by another transmission element, for example a toothed belt.

In particular, grooved guide 20 comprises an intermediate portion 21 that extends in a direction substantially parallel to advancement direction 7 and defines, as it will be clear from what follows, the cited work stretch A1. Intermediate portion 21 is connected to the portion of chain 17 looped around driving pulley 18 and tensioning pinions 19 by means of two vertical sections of chain 17, which are arranged, as clearly shown in FIGS. 4 to 9, at respective transverse through openings 22 of conveyor 6.

To this purpose, conveyor 6 comprises a first conveyor 23 disposed upstream from wrapping station 9, a second conveyor 24 disposed downstream of wrapping station 9, and an intermediate conveyor 25, which is separate from conveyors 23 and 24 by respective gaps, which extend perpendicularly to advancement direction 7 and define the aforementioned openings 22.

With reference to FIG. 3, each bar 15 extends from one to the other of plates 16 perpendicularly to advancement direction 7, and is rigidly connected to chains 17 by means of respective connecting elements fitted with respective ends of bar 15.

During operation, bars 15 are transported by chains 17 along path A so as to move always parallel to themselves and move along work stretch A1 in advancement direction 7 and along the return stretch in the opposite direction to advancement direction 7. Bars 15 move through conveyor 6, in a direction transverse to advancement direction 7 and to direction 11, at an inlet of the wrapping station 9, which inlet is defined by opening 22 arranged first in advancement direction 7, and at an outlet of wrapping station 9, which outlet is defined by the other opening 22. In other words, bars 15 move I a substantially vertical directions at the inlet of the wrapping station 9 and at the outlet of the wrapping station 9, i.e. at openings 22.

As will be described in more detail in the following, bars 15 intercept film 5 at the inlet of the wrapping station 9 and move with the film 5 along work stretch A1 at a speed higher than the speed of multi-packets 3 so as to wrap film 5 around multi-packets 3 and finally abandon wrapping station 9 at the outlet of the wrapping station 9.

As shown in FIG. 1, the feeding device 14 (of known type) is adapted to receive film 5 of heat-shrinkable material in the form of a continuous strip unwound from a reel (not shown) and comprises, in series in a advancement direction R of the strip, a longitudinal cutter (not shown) adapted to cut the strip in the direction R to obtain two strips, a pair of opposite and counter-rotating traction rollers 27, and a transverse cutter 28 adapted to cut the strips perpendicularly to direction R to obtain a succession of pairs of sheets 29.

Feeding device 14 also comprises a further pair of opposite and counter-rotating traction rollers 30 adapted to advance in succession pairs of sheets 29 on an aspirated inclined plane 31, which cooperates with upper surface of conveyor 25 at the inlet of the wrapping station 9 and is designed to guide sheets 29, launched through the relative opening 22, to the front edge of intermediate conveyor 25.

Figure 2:
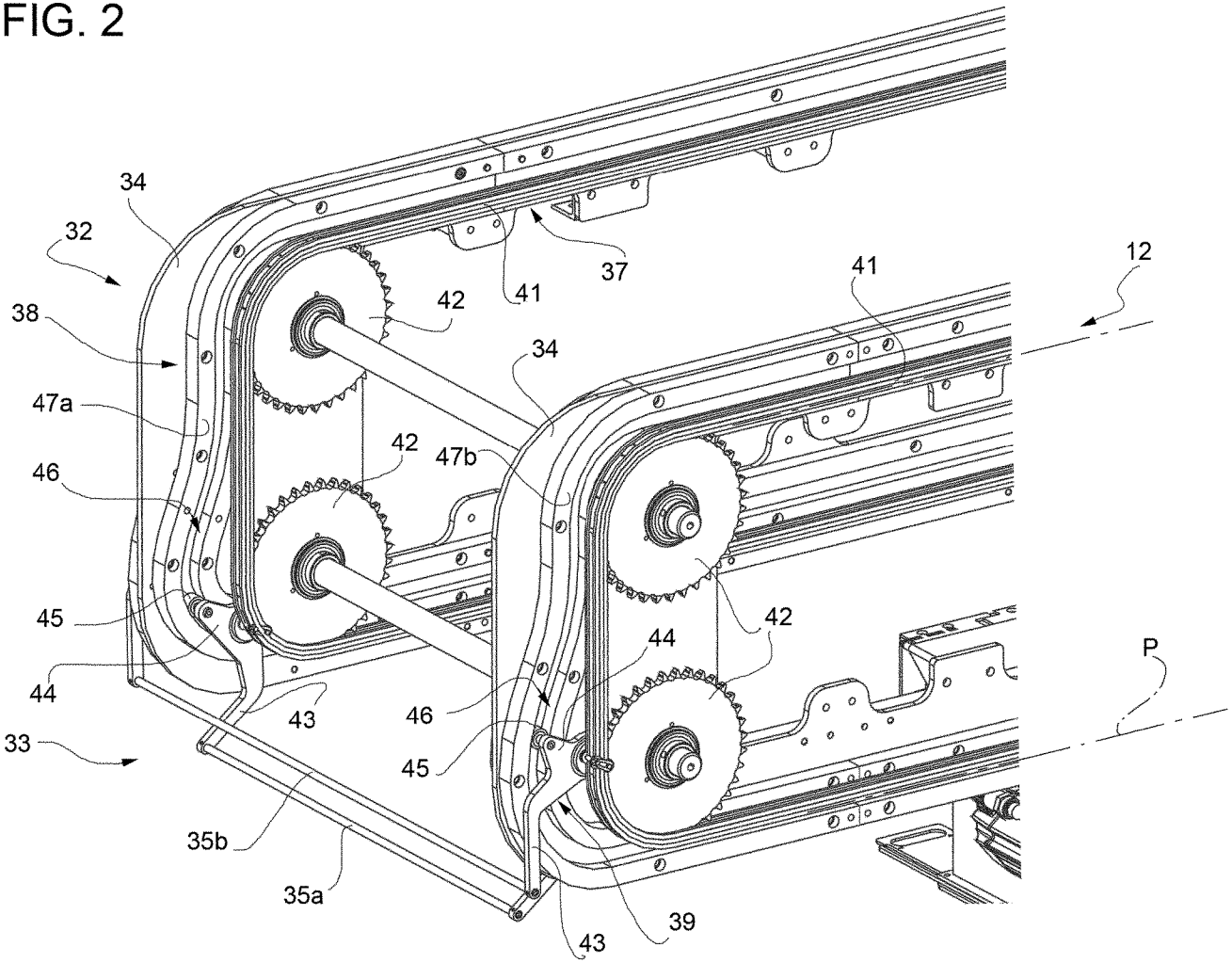
FIG. 2 shows a larger-scale perspective view of a detail in FIG. 1.

With reference to FIGS. 1 and 2, stability control group 12 comprises a frame 32, on which a plurality of mobile anti-tip devices 33 (only two of which are illustrated in FIG. 1) are mounted, whose function is to prevent packets 4 of a respective row 8 from losing their equilibrium and falling forward or backward with respect to advancement direction 7, before, during and after their advancement along conveyor 25, and, in particular, at transition area between intermediate conveyor 25 and first conveyor 23 and at transition area between intermediate conveyor 25 and second conveyor 24, i.e. at openings 22.

Frame 32 is arranged entirely above conveyor 6 and comprises two shoulders 34 rigidly connected to each other and defined by respective plates of generally rectangular shape, which lie on respective vertical planes parallel to advancement direction 7 and are arranged on opposite sides of conveyor 6.

Each anti-tip device 33 preferably comprises a pair of rods 35, which are parallel to the plane of conveyor 6 and perpendicular to advancement direction 7, and are movable, parallel to themselves, along an annular path P comprising a work stretch P1, along which rods 35 advance along conveyor 6 in advancement direction 7 and at the same speed as multi-packets 3, and a return stretch, along which rods 35 are moved in the opposite direction to advancement direction 7.

As will be clearly described in the following, along work stretch P1, each anti-tip device 33 is associated with a respective row 8 and the corresponding rods 35 are arranged on opposite sides of the same row 8, in respective positions facing to front and, respectively, rear faces of multi-packets 3 in the same row 8. Therefore, for the sake of clarity, in the description that follows rods 35 of each anti-tip device 33 will be indicated with reference numbers 35*a* and 35*b*, depending on they are arranged forward and, respectively, rearward in the advancement direction 7 along the stretch work P1.

With reference to FIGS. 4 to 9, each rod 35*a*, 35*b* is mounted on frame 32 to oscillate, when moving along work stretch P1, between a lowered or close position, in which rod 35*a*, 35*b* is facing to, and is conveniently in contact with, the respective face of row 8 in such a way as to define a transverse stop member movable with the same row 8, and a raised or spaced apart position, in which rod 35*a*, 35*b* is spaced from the relative side of the row 8, and defines, with row 8, a respective passage channel 36 adapted to permit, during operation, as will be explained in detail below, to a bar 15 to move through advancement path of rows 8 at the inlet of the wrapping station 9 and at the outlet of the wrapping station 9.

The anti-tip device 33 are uniformly distributed along aforementioned path P, and are moved synchronously along path P by means of a conveying device 37, which is, in the example shown, a chain transport device, but could be replaced by any other synchronous transport device suitable for that purpose, for example a toothed belt. Rods 35*a* 35*b* of each anti-tip device 33 are instead moved between the respective lowered position and raised position by means of a cam device 38.

As illustrated in FIGS. 1 and 2, each rod 35 is mounted to shoulders 34 of frame 32 by means of two fastening brackets arranged at ends of a respective rod 35 and defined by respective rocker arms 39, each of which is pivoted, by means of a respective pin 40 parallel to rod 35, on a respective chain 41.

The chain 41 may be replaced by another transmission element, for example a toothed belt.

Each chain 41 is mounted to a respective shoulder 34, is looped around four sprockets 42, of which one is a powered sprocket, and includes a forward lower stretch, which is parallel to advancement direction 7 and defines the aforementioned work stretch P1, and an rearward upper stretch, which is parallel to the lower stretch, defines the aforementioned return stretch and is connected to the lower stretch through two substantially vertical chain stretches.

Since each anti-tip device 33 comprises two rods 35*a* and 35*b*, and each rod 35 is provided with a pair of rocker arms 39, conveying device 37 includes four toothed chains 41, a first pair of which carries the rocker arms 39 that are associated with the rods 35*a*, and a second pair of which carries the rocker arms 39 that are associated with rods 35*b*. Preferably, the toothed chains 41 in the first pair are arranged facing one another on respective inner sides of shoulders 34, while the toothed chain 41 in the second pair are arranged on respective outer sides of shoulders 34. Anti-tip devices 33 are uniformly distributed along toothed chains 41.

As shown in detail in FIG. 2, each rocker arm 39 comprises a first arm 43, which extends up to and beyond the periphery of the respective shoulder 34, and has an end portion rigidly connected to one end of the respective rod 35, and a second arm 44, which is fitted, at its free end, with a follower 45 engaging in transversely sliding manner a track 46 of a respective annular front cam 47 which is integral with the relative shoulder 34.

Similarly to what said for toothed chain 41, stability control group 12 comprises four frontal cams 47, which define, all together, the aforementioned cam device 38 and comprise a first pair of front cam 47*a*, which is associated with rocker arms 39 of rods 35*a*, and a second pair of front cams 47*b*, which is associated to rocker arms 39 of rods 35*b*.

In particular, each front cam 47*a* and 47*b* is rigidly connected to an inner and, respectively, an outer face of a corresponding shoulder 34, and extends around the respective toothed chain 41.

As shown more clearly in FIGS. 4 to 9, track 46 of each front cam 47*b* comprises a straight portion 48 parallel to work stretch P1 and comprising a curved portion 50, which is arranged at the inlet of the wrapping station 9 and is shaped so as to cause, during operation, a rocker arm 39 passing through it to swing around the respective pin 40 so as to move relative rod 35*b* backward in an opposite direction to advancement direction 7.

Similarly, track 46 of each face cam 47*a* includes a straight portion 48 parallel to work stretch P1 and comprising a curved portion 49, which is arranged at an output of the wrapping station 9 and is shaped so as to cause, during operation, a rocker arm 39 passing through it to swing around the respective pin 40 so as to move the respective rod 35*a* forward in advancement direction 7.

With reference to the above, it is important to point out that, according to a variation not shown, each anti-tip device 33 may comprise a single rod 35. In this embodiment, the remaining rod will act, depending on whether it is a rod 35*a* or a rod 35*b*, as transversal stop member for a corresponding front or rear row 8. Resultingly, in this embodiment, conveying device 37 comprises only one pair of toothed chains 41, and cam device 38 only comprises a pair of front cams 47.

Finally, it should be specified that as previously described with respect to the stability control of two or more multi-packets 3 aligned along a relative row 8 is clearly applicable, without any substantial modification, even for the stability control of a different product, for example a single packet.

The operation of the wrapping material 1 will be described in the following with reference to FIGS. 4 to 9, which show, by way of example, a single row 8 advancing through the wrapping station 9.

Figure 4:
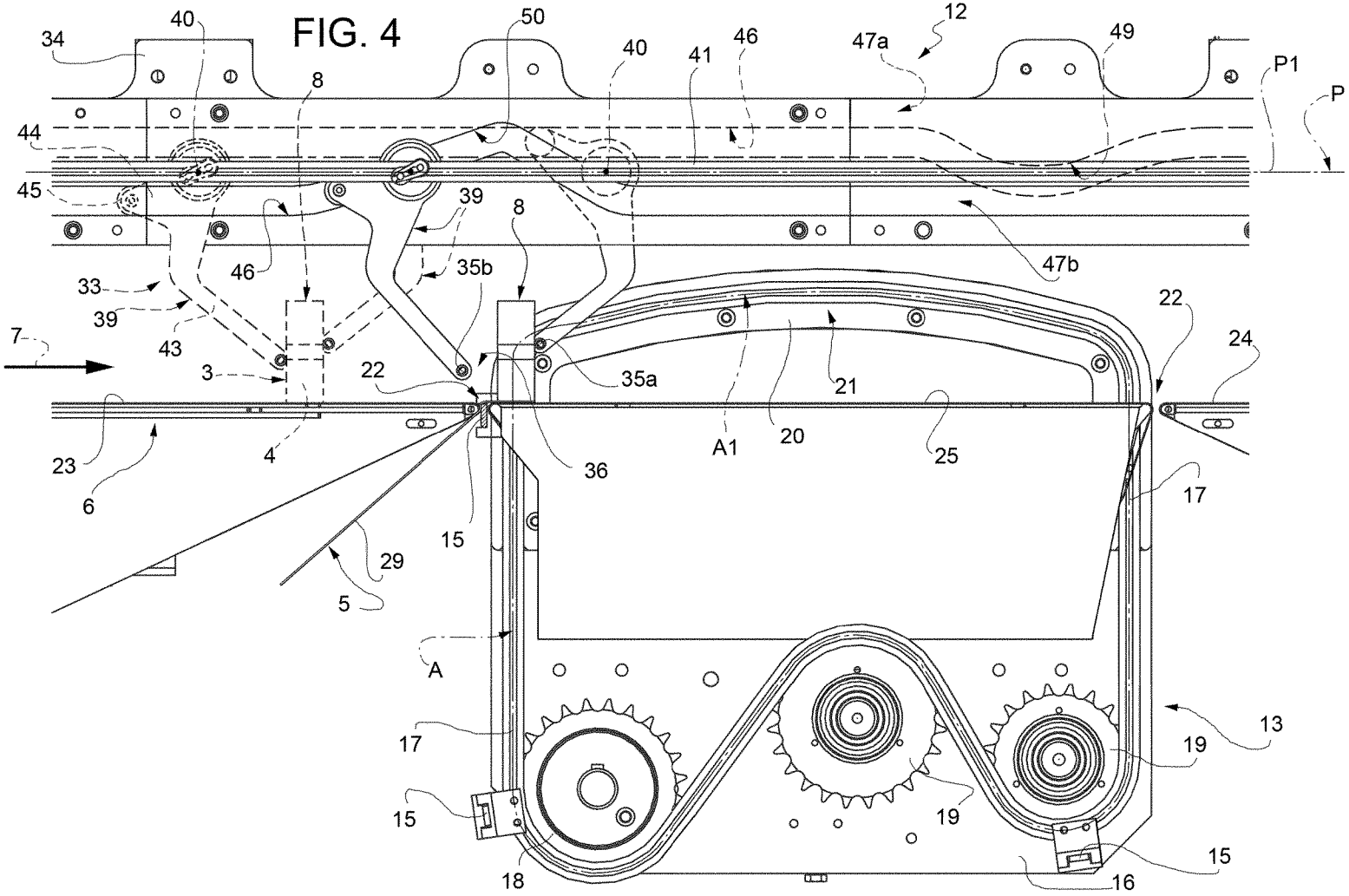
FIGS. 4 to 9 show larger-scale side views of a detail of the wrapping unit according to the present invention in different operating configurations.

As shown in FIG. 4, when a row 8 is on the conveyor 23 (row 8 drawn with dotted line), rods 35*a* and 35*b* of anti-tip device 33 associated with this row 8 are both arranged in the lowered positions. Under the action of the conveyor 23, row 8 comes to an inlet of the wrapping station 9 (row 8 drawn with continuous line) and, through the opening 22, is advanced to the conveyor 25. When row 8 passes onto conveyor 25, the front edge of each multi-packet 3 engages the front end of a respective sheet 29, which remains gripped below the multi-packet 3 and is dragged forward along conveyor 25.

Immediately before row 8 passes through opening 22 at the inlet of the wrapping station 9, followers 45 of rocker arms 39 which are fitted with rod 35*b* engage respective curved portions 50 of respective front cam 47*b*. As a result, as anti-tip device 33 advances in advancement direction 7 together with row 8, rocker arms 39 rotate around the respective pin 40 and space rod 35*b* apart from row 8 in a direction opposite to advancement direction 7, so as to allow the channel 36 to be formed between row 8 and rod 35*b* and a bar 15 to move upwards along channel 36. While row 8 proceeds along conveyor 25, bar 15 moves along portion A1 at a speed higher than that of conveyor 25 and wraps (in known manner) sheets 29 of the film 5 around the respective multi-packets 3.

Figure 5:
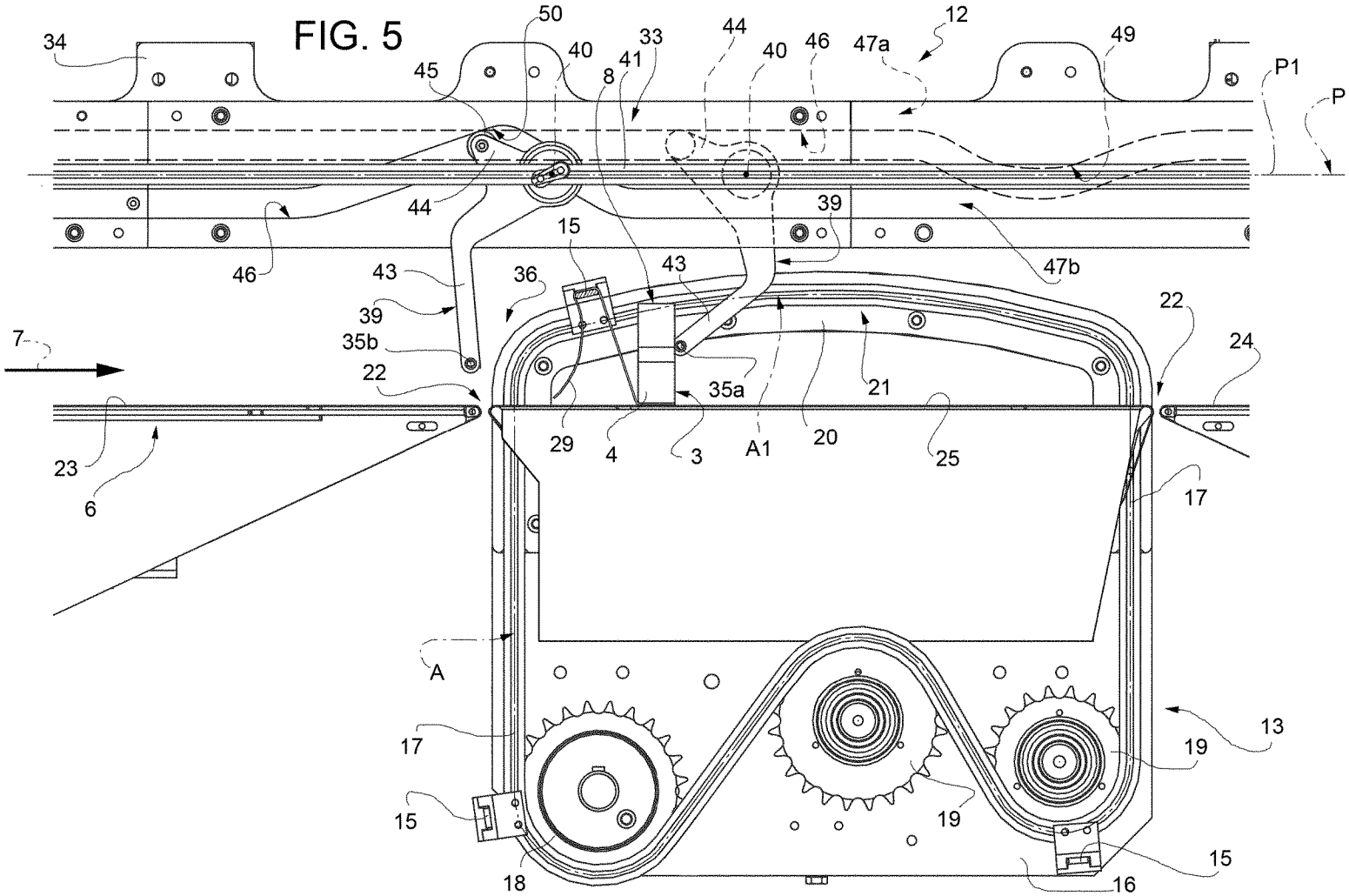

As shown in FIG. 5, curved portion 50 is designed so that, as soon as bar 15 has passed through opening 22, the relative rocker arms 39 rotate so as to bring rod 35*b* again in its lowered position, in which rod 35*b* acts as a rear transversal barrier for row 8.

Figure 6:
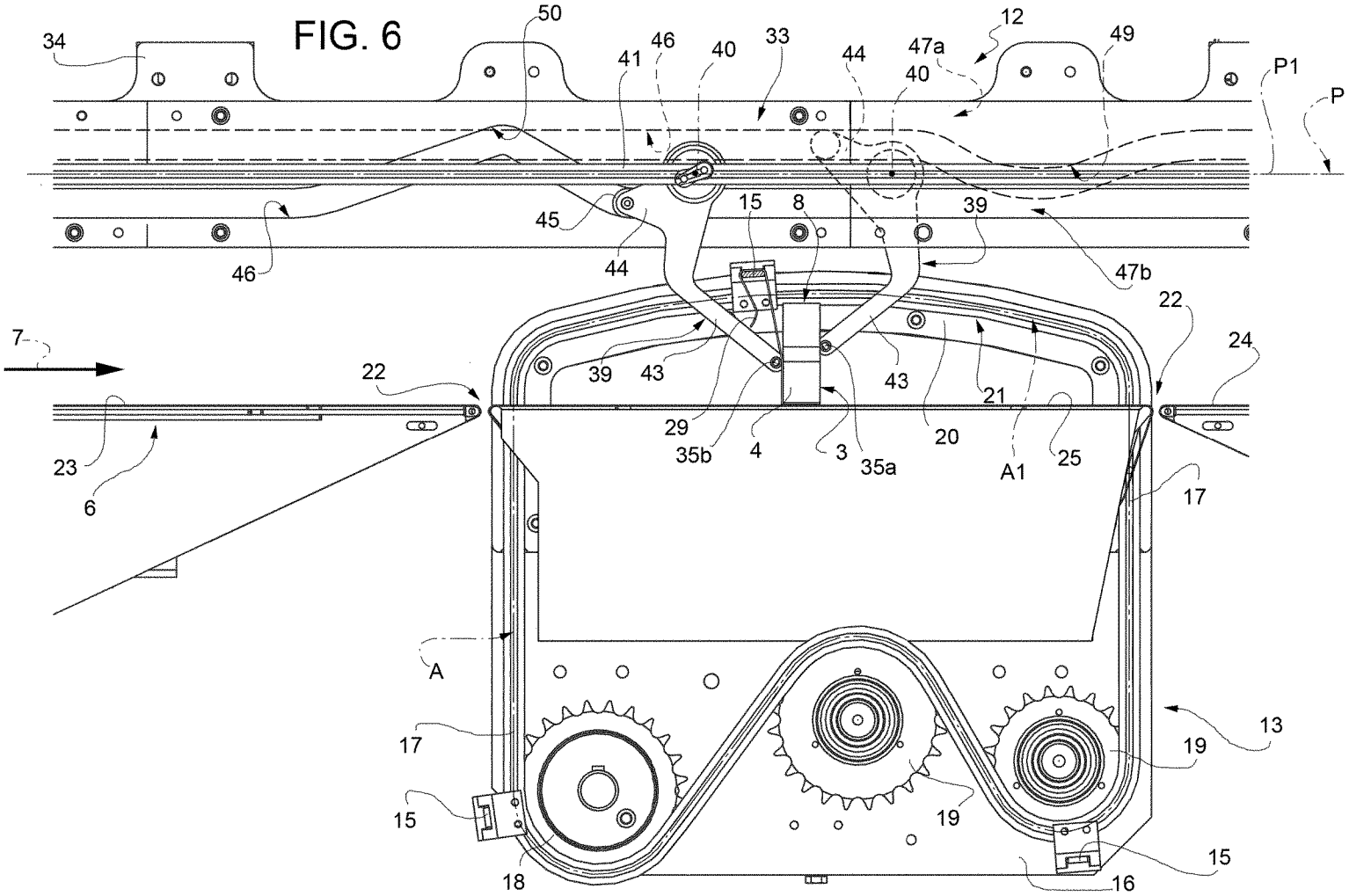

As shown in FIG. 6, movements of rod 35*b* and bar 15 are timed to each other such that, when rod 35*b* reaches its lowered position, bar 15 has wrapped sheets 29 around the rear face of the respective multi-packets 3 so that only a single layer of film 5 remains between rod 35*b* and rear face of multi-packets 3. In this way, rod 35*b* is prevented to hold the portion of sheet 29 still to be wound back against the action of bar 15 so causing the sheet 29 to be pulled out from the bottom of multi-packets 3.

Figure 7:
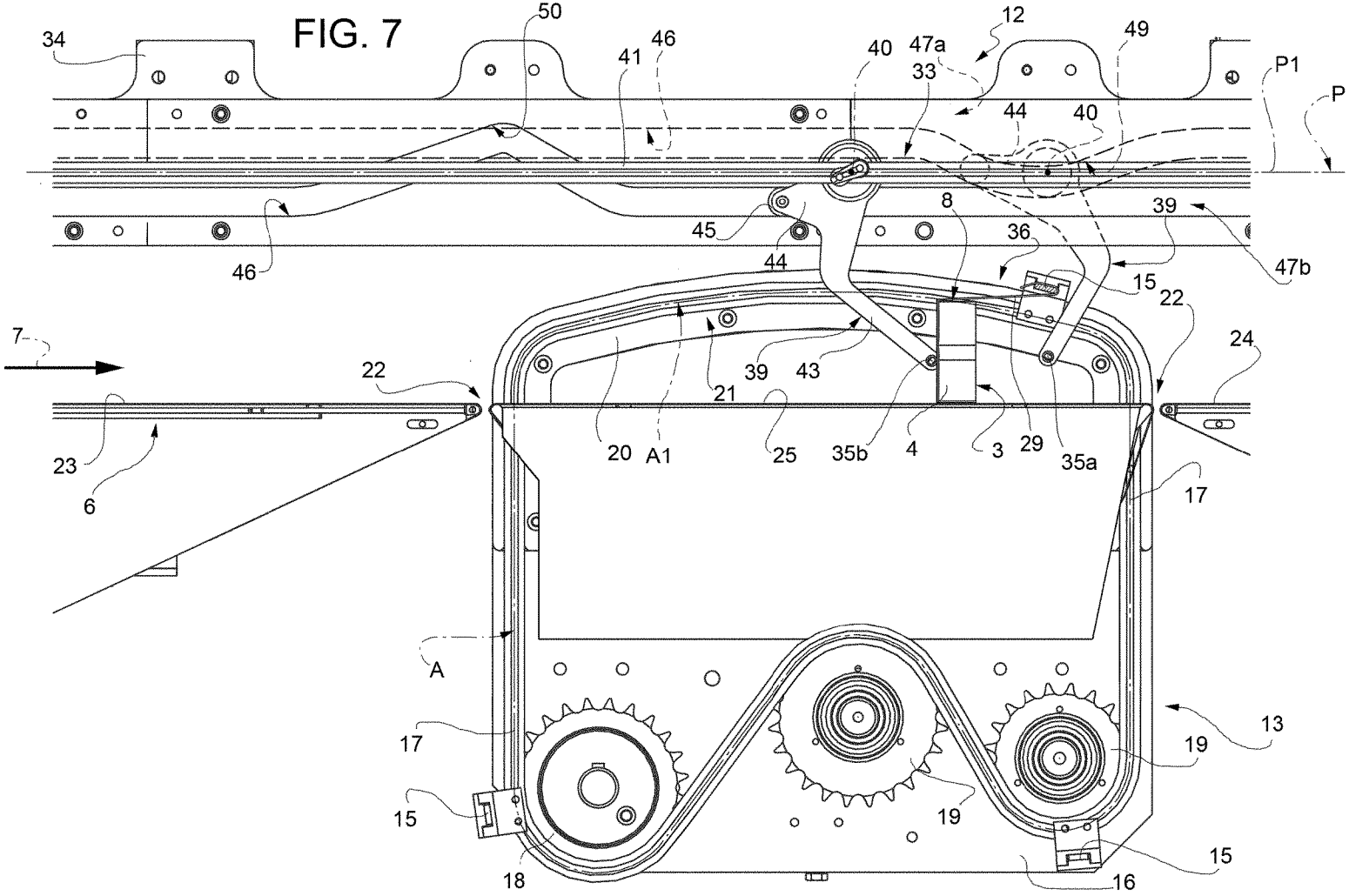
Figure 8:
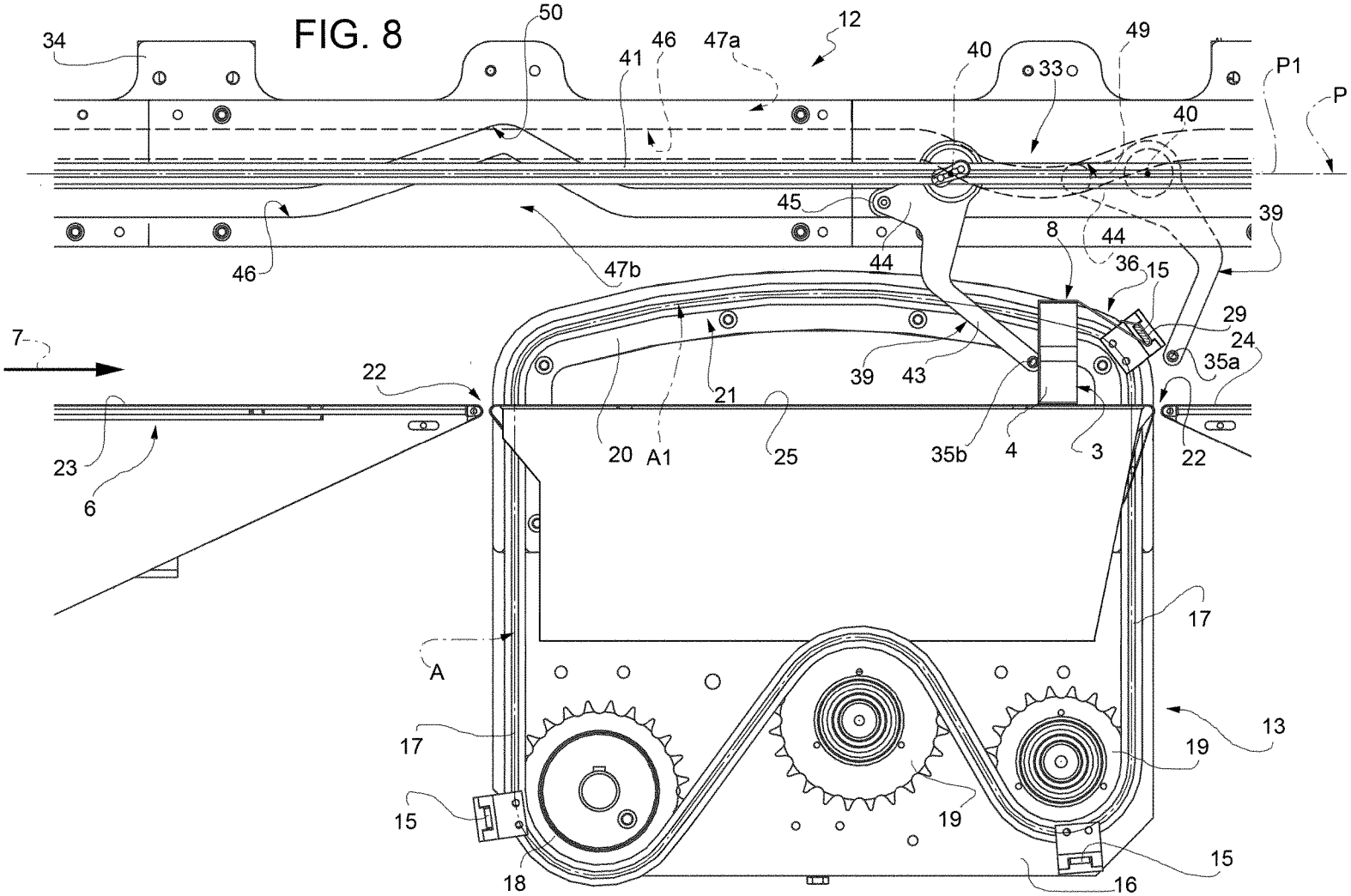

As shown in FIG. 7, before row 8 reaches the outlet of the wrapping station 9 and is transferred on the conveyor 24 through the relative opening 22, rocker arms 39 which are fitted with rod 35*a* behave in a similar way to what occurs to rocker arms 39 fitted with rod 35*b* close to the inlet of the wrapping station 9. In fact, when bar 15 gets close to the terminal portion of stretch A1, followers 45 of rocker arms 39 fitted with rod 35*a* engage respective curved portions 49 and cause the respective rocker arms 39 to rotate with consequent spacing apart of rod 35*a* from row 8 in advancement direction 7 and formation of channel 36 between rod 35*a* and the front face of multi-packets 3.

Figure 9:
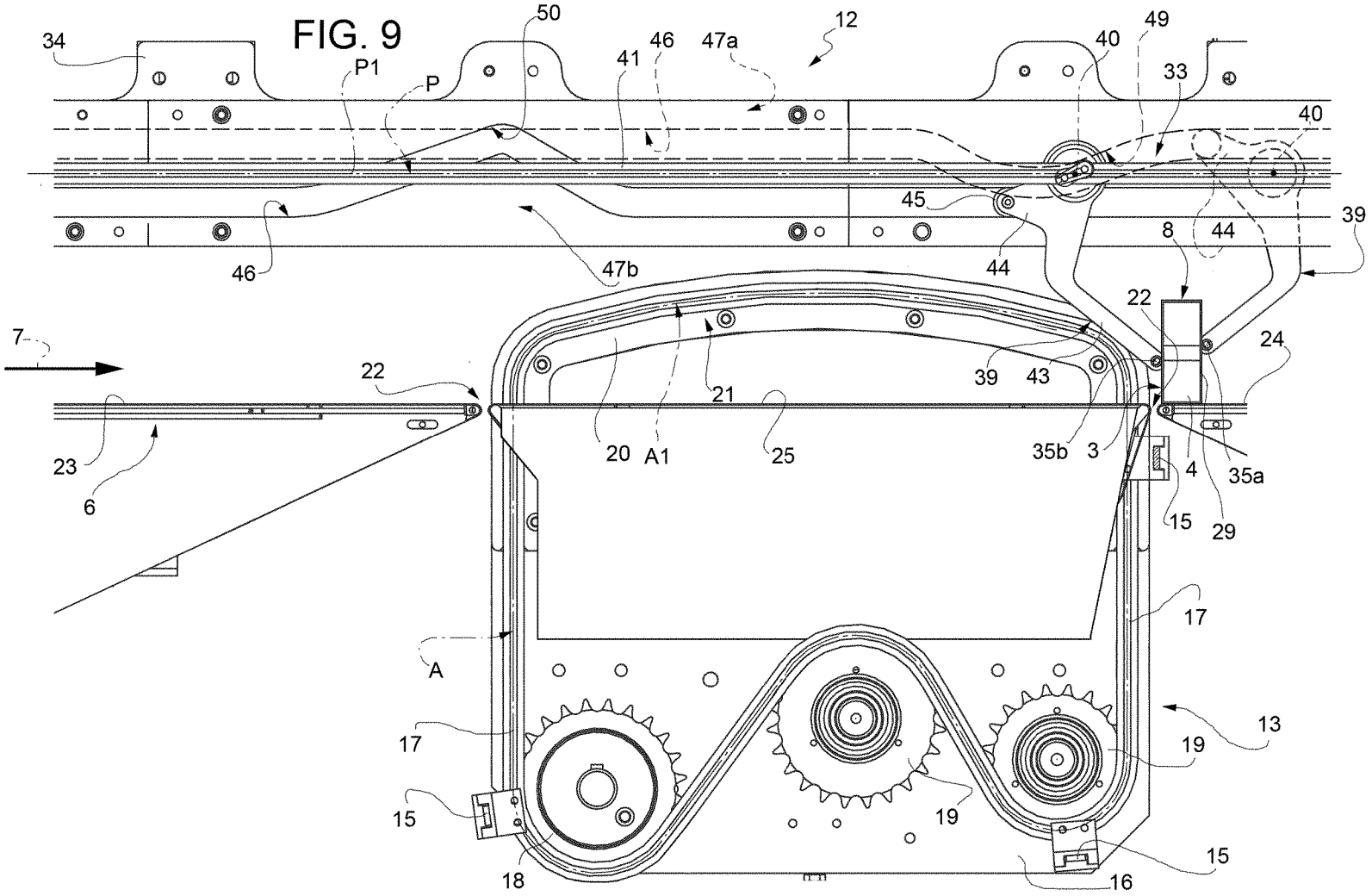

The profile of curved portion 49 is designed such that rod 35*a* is substantially in its raised position when bar 15 passes through aperture 22 and returns to the lowered position when row 8 has finally reached conveyor 24 (FIG. 9).

From the foregoing it is possible to understand the advantages associated with wrapping unit 1 of the present invention and resulting from the presence of stability control group 12 in combination with the film wrapping device 13.

In particular, anti-tip devices 33 are able to support, if necessary, rows 8 before, during and after the wrapping station 9 by acting as fixed barriers without exerting any direct gripping thrust on packets 4 and, therefore, without the risk of damaging the packets 4. At the inlet of the wrapping station 9 and at the outlet of the wrapping station 9, anti-tip devices 33 are configured in such a way to effectively and quickly disengage respective rows 8, especially in view of the considerable speeds at which row 8 are moved, and to the time strictly necessary to allow the passage of bars 15 and film 5, while maintaining a partial supporting action of multi-packets 3 due to the presence of at least one among rods 35*a*, 35*b*.

The invention claimed is:

1. A wrapping unit for a packaging line, comprising: a conveyor for feeding a succession of products in a first direction; a wrapping station arranged along the conveyor for wrapping a film of wrapping material around said products, said wrapping station comprising: a wrapping device provided with a plurality of wrapping members, each of said wrapping members extending in a second direction perpendicular to said first direction, and a stability control group for preventing said products from tipping along said conveyor, said stability control group comprising: a plurality of anti-tip devices, each of said anti-tip devices being associated, during operation, with a respective one of said products to move together with said respective product through said wrapping station;

wherein each of said anti-tip devices comprises at least one stop member, which extends in said second direction and is operable to assume a close position, in which said stop member is arranged close to and facing a front face or rear face of said product, and a spaced apart position, in which said stop member is arranged at a determined distance from said product and defines, with said product, a passage for a wrapping member;

wherein each anti-tip device comprises a pair of said stop members, which are adapted to be disposed on opposite sides of said respective product;

wherein each pair of stop members comprises a rear stop member and a front stop member, according to said first direction, said rear stop member being adapted to move from said close position to said spaced-apart position at an inlet of the wrapping station and to remain in said spaced-apart position sufficient to allow the wrapping member to move, together with said film, through a corresponding passage to above said rear stop member, and said front stop member being configured to move from said close position to said spaced-apart position at an outlet of said wrapping station and to remain in said spaced apart position for sufficient time to allow the wrapping member to move, together with said film, through a corresponding passage to below said front stop member.

2. The wrapping unit according to claim 1, wherein said stability control group comprises a frame and a conveying device carried by said frame to advance said anti-tip devices along a predetermined path, said pair of stop members of each anti-tip device being operable independently from each other so that, when one of said stop members moves from said close position to said spaced apart position and vice versa, the other of said stop members remains in said close position.

3. The wrapping unit according to claim 2, wherein said path is an annular path comprising a substantially straight work stretch extending parallel to said conveyor, said anti-tip devices being movable along said work stretch at the same speed as said conveyor.

4. The wrapping unit according to claim 2 wherein said stability control group comprises a cam device carried by said frame and coupled to each stop member to move said stop member from said close position to said spaced apart position and vice versa.

5. The wrapping unit according to claim 4, wherein said cam device comprises a pair of first cams coupled to said rear stop members and a pair of second cams coupled to said front stop members.

6. The wrapping unit according to claim 1 wherein each stop member comprises a rod that extends in said second direction and is mounted to the conveying device to move along said path and oscillate between said close position and said spaced apart position around an axis parallel to said second direction.

7. The wrapping unit according to claim 6, and further comprising, for each stop member, two rocker arms, each of which is fitted with a respective end of the relative rod to couple said rod with said conveying device and said cam device, each rocker arm being hinged to said conveying device about said axis and comprising a first arm rigidly connected to said rod and a second arm that carries a follower engaged with said cam device.

8. The wrapping unit according to claim 7, wherein each follower of each rear stop member slidably engages a track of a respective first cam, and each follower of each front stop member slidably engages a track of a respective second cam.

9. The wrapping unit according to claim 1, wherein each wrapping member is arranged to move, at an input of said wrapping station and/or at an output of said wrapping station, in a third direction transverse to said first direction and to said second direction.

* * * * *